US005469641A

United States Patent [19]

Subotic

[11] Patent Number: 5,469,641

[45] Date of Patent: Nov. 28, 1995

[54] CUSTOM BALLET POINTE SHOE

[76] Inventor: Goran Subotic, 25 Willow St., Mystic, Conn. 06355

[21] Appl. No.: 380,556

[22] Filed: Jan. 30, 1995

[51] Int. Cl.[6] ..... A43B 7/14

[52] U.S. Cl. ..... 36/93; 36/94; 36/71

[58] Field of Search ..... 36/8.3, 88, 93–96, 36/71, 8.4, 77 R, 77 M, 114, 55

[56] References Cited

U.S. PATENT DOCUMENTS

| | | | |
|---|---|---|---|
| 1,257,086 | 2/1918 | Marcellus | 36/8.8 |
| 1,704,281 | 3/1929 | Capezio | 36/8.3 |
| 2,618,870 | 11/1952 | Tarlow | 36/55 |
| 3,325,919 | 6/1967 | Robinson | 36/93 |
| 3,410,004 | 11/1968 | Finn | 36/93 |
| 4,809,379 | 3/1989 | Jungwirth | 36/93 |
| 5,184,411 | 2/1993 | Corletto | 36/88 |
| 5,259,126 | 11/1993 | Rosen | 36/93 |

FOREIGN PATENT DOCUMENTS

| | | | |
|---|---|---|---|
| 136415 | 4/1985 | European Pat. Off. | 36/8.3 |
| 2660168 | 10/1991 | France | 36/8.3 |
| 405095804 | 4/1993 | Japan | 36/96 |

*Primary Examiner*—Thomas P. Hilliard

[57] ABSTRACT

The custom ballet pointe shoe, with the capability to adjust the internal volume of the ballet pointe shoe, to custom-fit to the dancers foot, allowing for equalizing the vertical weight bearing to be distributed across all toes and front of the foot in all ballet "Sur le pointe" positions. The pointe shoe has a built-in sock liner covering the front of the foot, and establishing the space, closed cavity, between the front of the foot and the unshaped box of the ballet pointe shoe. After inserting the foot into the pointe shoe, the cavity is filled with the product or mixture of products, which has the capability to harden and cure, taking the permanent shape of the inserted dancers foot. The present method makes the shoe comfortable, the weight is now equally distributed, not just on the tops of the toes, but also on the whole front of the foot, when the dancer is in a "Sur le pointe" position.

1 Claim, 6 Drawing Sheets

FIG. 5
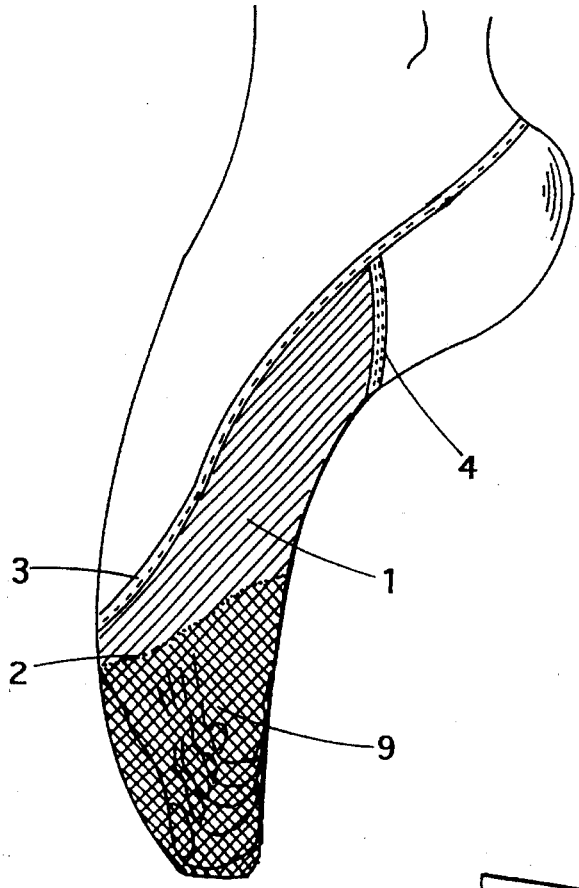
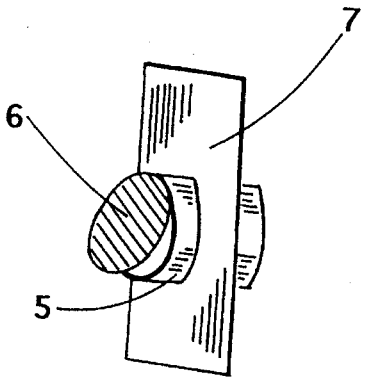
FIG. 6
FIG. 7
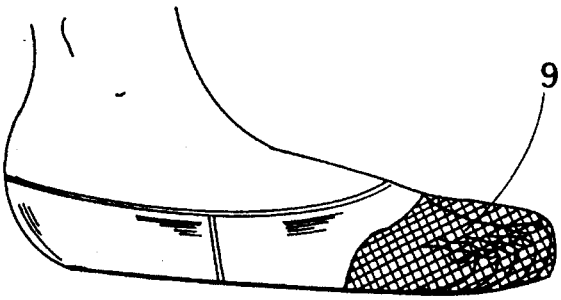

CUSTOM BALLET POINTE SHOE

CROSS-REFERENCE

| U.S. Pat. Documents | | | |
|---|---|---|---|
| 1,813,561 | 7/1931 | Capezio | 36/113 |
| 2,210,304 | 8/1940 | Poole | 36/8.5 |
| 4,120,064 | 10/1978 | Salomon | 36/93x |
| 4,412,393 | 11/1983 | Terlizzi | 36/113 |
| 5,129,165 | 7/1992 | Woodle | 36/8.3 |
| Foreign Patent Documents | | | |
| 2337517 | 4/1974 | France | 36/113 |

BACKGROUND OF THE INVENTION

The present invention relates to the process of manufacturing adjustable custom ballet pointe shoes and the method of adjusting the internal volume of the ballet pointe shoe, to custom-fit to the dancers foot, allowing for equalizing the vertical weight bearing to be distributed across all toes and front of the foot in all ballet "sur le pointe" positions. The "Sur le pointe" position, is when the ballet dancer rises up onto the tips of the toes, using ballet pointe shoes. The existing ballet pointe, or toe shoe is a special shoe, made with an extremely hard box, which wraps around the metatarsal and toes. The box is inflexible, which doesn't allow it to mold to the dancers foot. The pointe position, in previous pointe shoes, results in unequal weight distribution across the dancers toes, and combined with the hard unshaped box of the pointe shoe, causes extreme discomfort and pain to the dancer. The problem is compounded by the fact that the unshaped box allows the toes enough room to shift and rub against the walls of the box and also allows the toes to fold under the pressure of the body weight in the "sur le pointe" position. The result of unequal weight distribution, rubbing toes and folding toes, causes temporary, and, or permanent injury, for dancers toes, feet, ankles, knees and hips. This also effects a dancers alignment or "line" and proper technical execution.

In the past, there has been a few attempts to provide a certain amount of comfort and help for weight distribution, such as toe padding U.S. Pat. No. 2,210,304 by T. V. Poole. In which, the use of sheepskin, wool, or sponge rubber are worn inside the shoe, without a desirable effect. Under pressure wool, sponge, rubber pads and the like, compact. In the U.S. Pat. No. 5,129,165 by Alan S. Woodle, a silicone rubber based custom toe cap is explained. The silicone rubber cap was meant to be worn inside the tights, directly on the toes. Since the rubber compound does not absorb moisture it can become slippery and shift. Also it is meant to cover only tips of the shorter toes, which only solves part of the problem of weight distribution. The method for establishing the toe cap, takes place while the dancer is in the pointe position. The dancer must maintain this position to let the compound set. In this position the dancers toes are already bent and collapsed. The rubber based compound takes the shape of the toes in a bent and collapsed position. Due to this, the prior art only partially reduces the pressure on the dancers big toe. The inconvenient way of applying the rubber based compound, and the time the dancer must hold a "sur le pointe" position makes this method unable to offer easy and simple use for the general public.

DESCRIPTION OF THE PRIOR ART

The process of manufacturing the new custom ballet pointe shoes relates for improving the box of the prior art ballet pointe shoes. FIG. 8 illustrates the method used in a conventionally fabricated ballet pointe shoe.

The toe shoe upper 110 shown in FIG. 8 is comprised of three basic layers, the decorative, outer layer 112 of satin, or the like, the intermediate layer 114 of a soft fabric, such as cotton, and the inter, foot contacting layer 116 of a soft fabric such as cotton. The upper, comprised of these three layers is generally curled up, with the outer layer 112 on the inside of the curled upper. To define the more rigid toe boxregion of the ballet pointe shoe, a craftsman pulls back the decorative layer 112 and the intermediate layer 114, exposing the top of the bottom, innermost layer 116. A piece of fabric 118, a gauze-like material is cut out to have an external profile generally like the upper of the ballet toe shoe. The toe box region has adhesive applied to it. It is then adhered to the layer 116. A small pad 120 of felt, or the like, is adhered by adhesive to the layer 118 at the ballet toe shoe, which must be the most rigid. On top of the layer 120 and the gauze layer 118, another layer 122 having the profile generally of the layer 118 is attached by adhesive. The layers 118 and 122 therefore cover the toe box region of the toe shoe and the area slightly rearwardly of the front tip or the toe shoe.

As described earlier herein, the process of manufacturing the box of the ballet pointe shoe is one of the conventional ways, but also relates to any other variation or modification of the prior arts that have not been described.

THE SUMMARY OF THE INVENTION

The method, according to the present invention, relates to the new pointe shoe that has a built-in sock liner covering the metatarsal and toes inside the box. This establishes the space between the foot and the unshaped box, creating the cavity to be filled. On the outside tip of the box on each shoe is an injection opening. Through the injection opening an injected polyurethane foam or soft reformable material, such as a highly viscous product, for instance a modeling compound a specific amount of which is positioned at the time of manufacture which will be injected under pressure. The inside of the sock is a cotton or any other moisture absorbing material. The outside of the sock layer is an impermeable material. The cotton side will absorb moisture from the dancers foot and the opposite, impermeable side will prevent penetration of the injected substance.

The dancer places the feet in shoes so that the injection opening is on the outside corners. The right shoe has its injection opening on its right corner and the left shoe has its injection opening on its left corner. The moldable mixture will be injected into the cavity of the shoe while the dancer stands in a regular flat standing position. This will allow the moldable mixture to fill all cavities around the front of the toes, top of the toes up to, but not covering the metatarsal. After the moldable mixture sets and cures the method will allow total weight distribution for all toes and top of feet. The dancers weight is now equally distributed, not just on the tops of the toes, but also on the whole front of the foot when the dancer is in a "Sur le pointe" position.

BRIEF DESCRIPTION OF THE DRAWINGS

FIG. 5—Configurational side view of the custom ballet pointe shoe with foot, and moldable mixture in place.

FIG. 6—Illustrates view of injection tube.

FIG. 7—Configurational side view of foot in flat standing position, in custom ballet pointe shoe and moldable mixture in place.

DESCRIPTION OF PREFERRED EMBODIMENT

Figure 3:
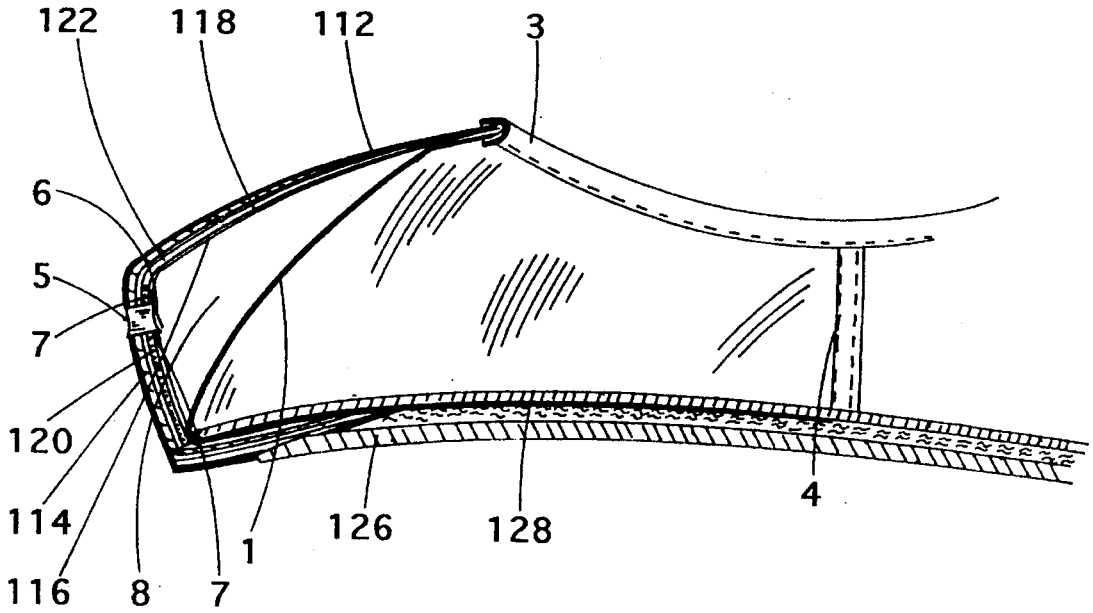
FIG. 3—Elevational, longitudinal, cross-sectional view of custom ballet pointe shoe.

The custom ballet pointe shoe shown in FIG. 3 includes the injection opening 5 and toe sock 1 in the box of the pointe shoe.

Figure 1:
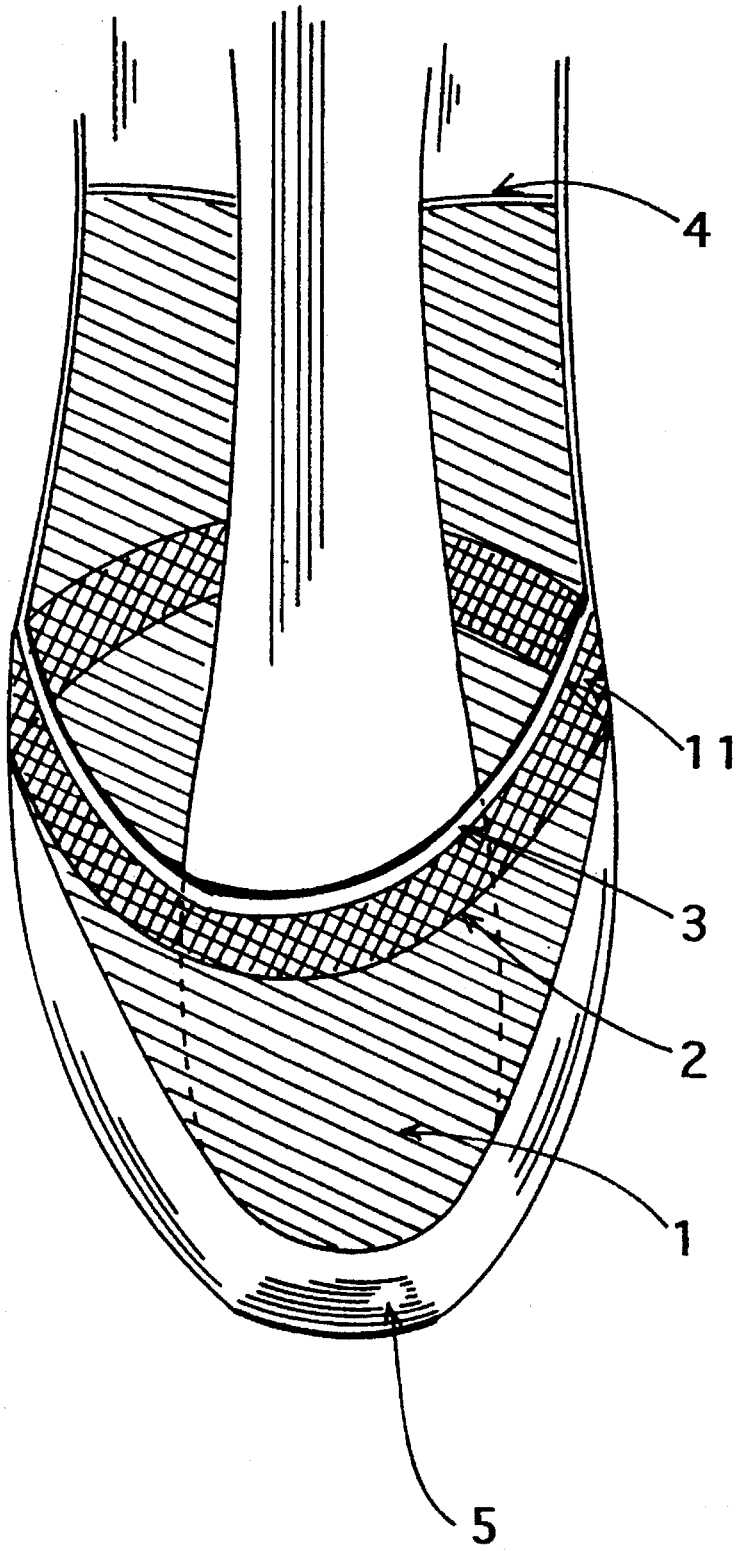
FIG. 1—Elevational view of the custom pointe shoe with "toe sock" lining.
Figure 2:
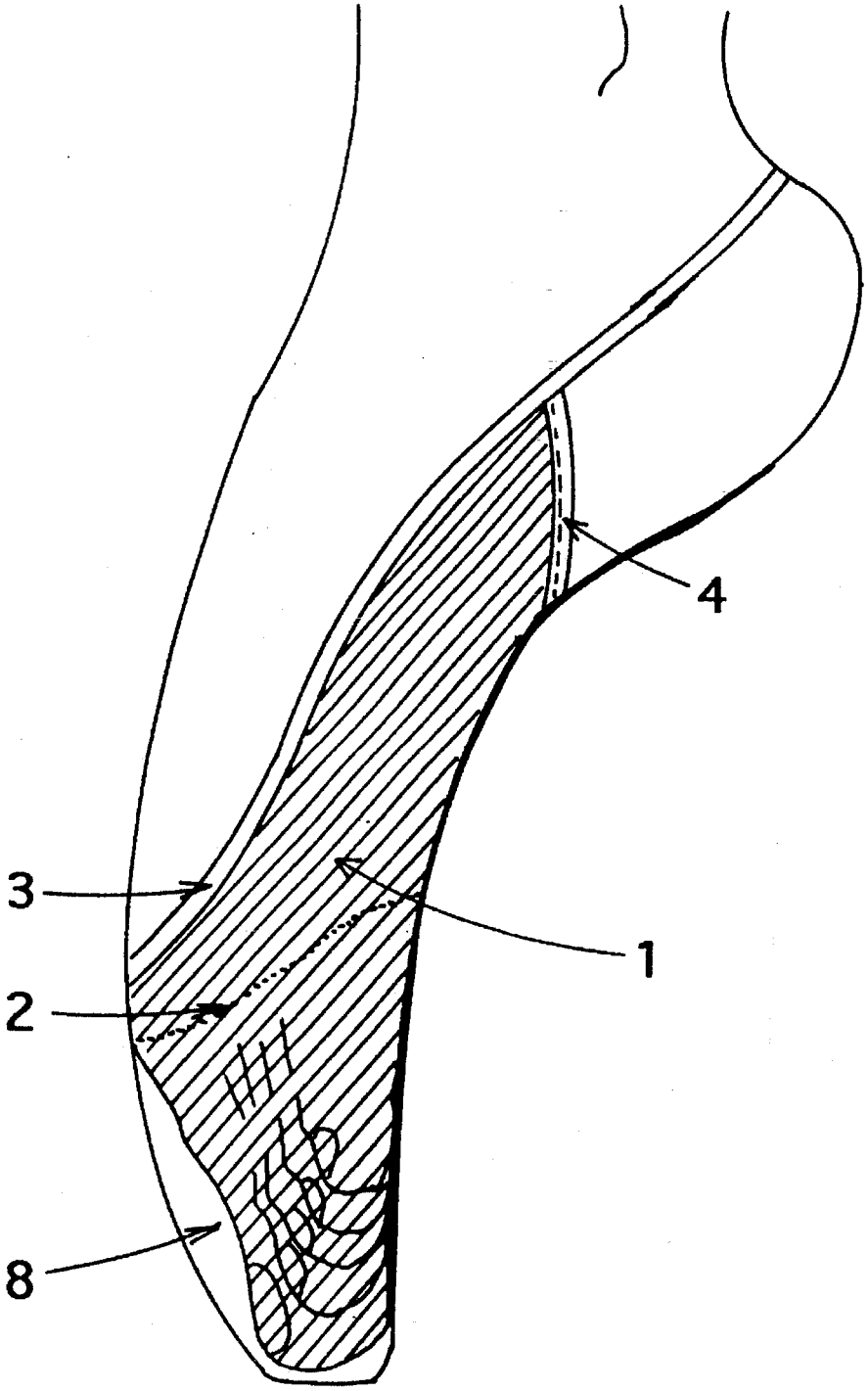
FIG. 2—Configurational side view of custom pointe shoe with foot place in "toe sock".

According to this invention, the layer 1—said toe sock, is added to the already existing layers of the prior art. New layer is in contact with the dancers foot. The craftsman pulls back all upper layers, exposing the top of the toe sock layer 1. The adhesive is applied to the sock layer all around the entire metatarsal part of box 11, but only from the top of the metatarsal 2 and extended to the drawstring 3, illustrated in the FIG. 1. The said toe sock is attached to the layer 116 with a flexible adhesive. This is providing that the cavity space is terminated and stopped at the top of the metatarsal and using flexible adhesive will allow the dancer to "break in" the shoe and "roll down" off the pointe position. In the new invention, layer 116 is an impermeable material FIG. 4. Said toe sock is made of cotton, or of the like, material able to absorb moisture from one side the side in contact with the dancers foot. The opposite side of the toe sock is impermeable. The toe sock material has to be able to stretch, so that the toe sock can take the shape of the dancers foot, illustrated in the FIG. 2. Said toe sock is extend to be attached under the draw string 3 and at side seams 4 of the shoe by stitching in the same method as other layers FIG. 3. From the top of the metatarsal said sock is brought forward, stretched over and around the pointe shoe last, to the periphery of the tip, and sides of the shank 128 of the pointe shoes. This is providing a smooth fit to the dancers foot when inserted in the custom pointe shoe. This allows the sad toe sock to take the shape of the foot without wrinkling, during the process of injecting the moldable mixture.

Said sock is placed with the other materials of the upper, beneath the shank 128 and is fastened inside the pointe shoe to the outer sole 126 shown in FIG. 3. The impermeable layer 116 and impermeable side of said sock 1, facing each other is providing a secure cavity 8 for the moldable mixture to fill, after the dancer foot is inserted.

Figure 4:
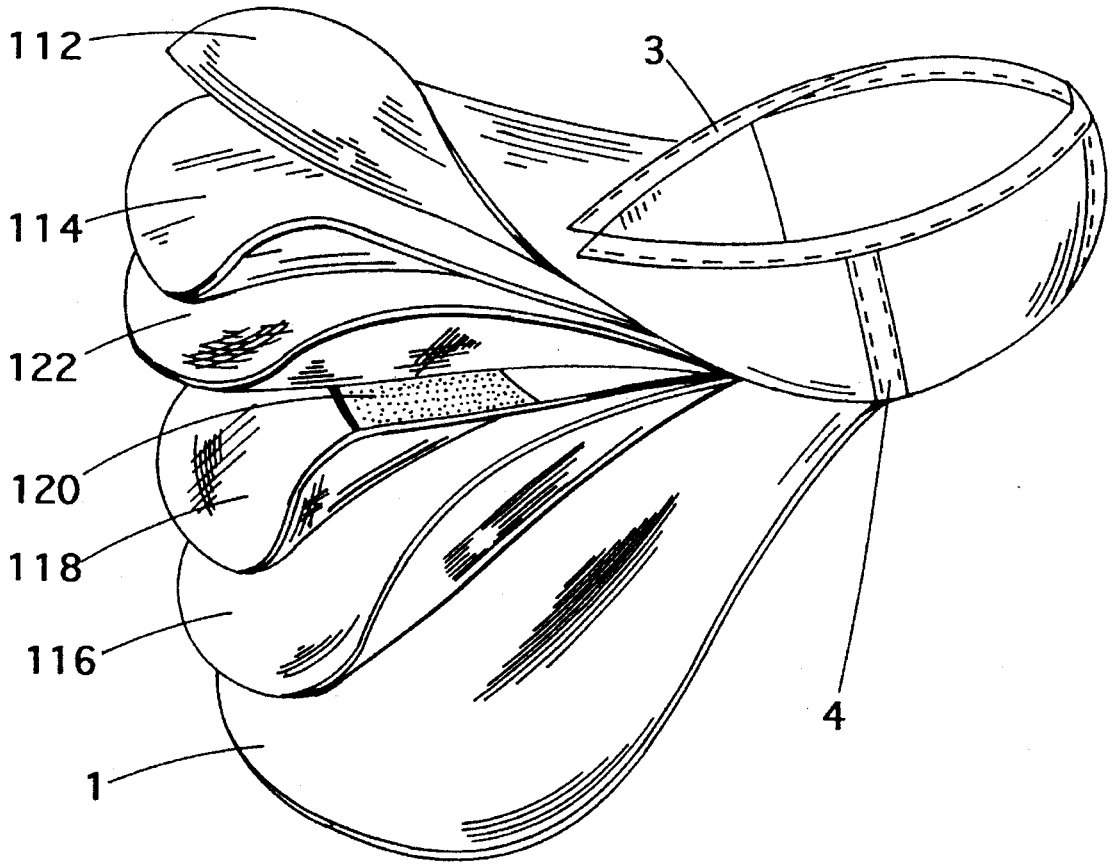
FIG. 4—Illustrates upper used in producing custom ballet pointe shoe.
Figure 8:
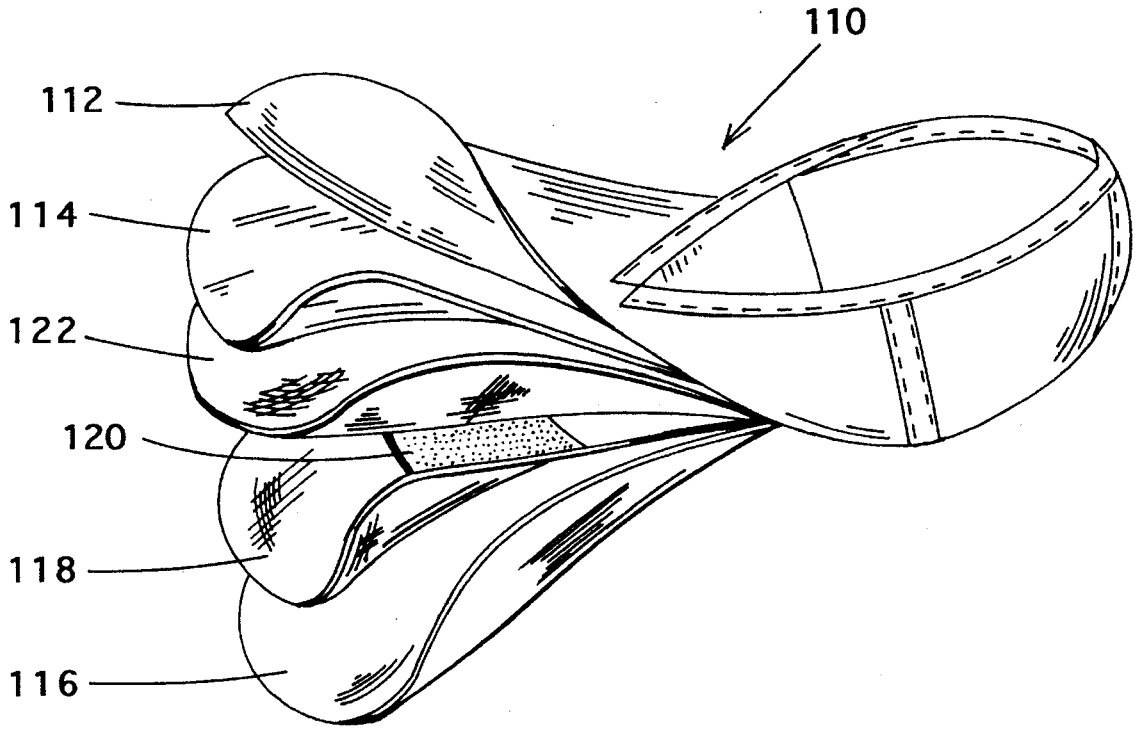
FIG. 8—Illustrates upper used in producing a ballet pointe shoe according to prior art.

In FIG. 4 layers 112, 114, 116 and also mid layers 118, 120, 122 are punctured with a hole approximately 3/16 of an inch. In the process of manufacturing the box of the custom ballet pointe shoe, after toe sock layer 1, is covered with layer 116 and layer 118 is applied, and attached by adhesive to layer 116 the injection tube 5 is installed in the existing hole through the layers 116 and 118. The injection tube is installed so that the security membrane is in the inside of the cavity. Shown in FIG. 6 the injection tube has a security membrane 6 that can stop the injected moldable mixture from escaping from the cavity 8 after being injected. The security wings of the injection tube 7 is laid on to layer 118. After the adhesive is applied layers 120, 122, 114 and 112 are now laid on top of layer 118 and secured with an adhesive as previously explained. The injection tube 5 is exactly, as long as the thickness of the wall of the box of the pointe shoes. Injection tube is installed in the upper right corner of the flat tip of right pointe shoe, and installed in the upper left corner of the flat tip of the left pointe shoe. This will insure the best results, so the moldable mixture 9 will fill the cavities around all five toes and the front of foot as shown in FIG. 5.

In the process of manufacturing the new custom ballet pointe shoe, it may not be necessary to install as many mid layers as in the prior art for the purpose of rigidness, due to the fact that the moldable mixture that will fill all cavities in the box will make the box durable and strong.

METHOD FOR ADJUSTING BALLET POINTE SHOE TO DANCERS FOOT

According to the present invention, method is providing simple, clean and permanent way to solve the problem of total weight distribution, comfort, and technical alignment for the dancer.

Referring to FIG. 7 illustrating the position of the shoe with dancers foot inserted in a "flat", standing position. In this position the moldable mixture 9 is injected to fill the cavity. The novel custom ballet pointe shoe is designed to allow for injecting a moldable mixture after inserting and properly placing dancers foot in the shoe. A flat position allows the foot to remain in a natural position. With the dancers foot placed in the pointe shoes, in the flat position, the moldable mixture is injected through the injection tube. The moldable mixture is injected by placing an opening of the container through the injection plastic tube, and injected by pressure, into the cavity. First in one, and after, in another shoe. A specific amount of which is positioned at the time of manufacture.

For the purpose of filling the cavities, said customized pointe shoe is injected with an adjusting material(s) and mixture of materials, such as polymeric isocyanate, polyol resin, hydrochluorocarbons, or any other materials most commonly used which hardens by polymerization, modeling compounds or moldable mixtures described in U.S. Pat. No. 4,120,064 for filling the cavity in a ski boot, or any other existing or new materials or moldable mixtures. The dancer remains in this position until the moldable mixture has cured, approximately 40 minutes. The opening of the injection tube and tip of the pointe shoe can be covered with mole skin. The injected moldable mixture fills the cavity around all toes and front of foot FIG. 7 making a custom ballet pointe shoe. After the process is complete and the moldable mixture has cured, the dancer has a solid support for the whole front of the foot including the top of the metatarsal FIG. 5 in the pointe position. Since the novel invention allows the moldable mixture to secure not just the top of the smaller toes, but also all toes and all around the front of the foot and metatarsal, equalizing the vertical weight to be distributed across the whole front of the foot. The present method, also keeps the foot from shifting, or rubbing against the walls of the box, preventing skin damage. The present method provides a simple, clean efficient way of making custom ballet pointe shoes for the user. This also makes the present invention accessible for the general public and commercial use.

What I claim as my invention is:

1. A ballet pointe shoe comprising:

an upper of flexible material having a forefoot layer, an instep area, an opening for insertion of the foot, side seams, and a front portion having a flat front tip;

a sole having a shank;

a stretchable toe sock located in the front portion of the upper in direct contact with the wearer's foot, the toe sock attached to the upper along at least a portion of the perimeter of the opening for insertion of the foot, along the side seams, and along the shank creating a cavity between the forefoot layer of the upper and the toe sock, the toe sock and the forefoot layer of the upper each having a liquid impermeable surface facing the cavity;

the toe sock and the forefoot layer of the upper attached together such that the cavity is adjacent the front portion of the upper, extending from the flat front tip to the instep area of the upper and down to the shank, and such that when filled the cavity will surround only the front part of the foot from the front of the toes, on the top of the toes to the tops of the metatarsals, and along the sides of the toes;

an injection opening through the flat front tip of the upper penetrating into the cavity, the opening located in an upper comer of the flat front tip;

an injection tube located in the injection opening, the tube having a security membrane to prevent an injected filling product from escaping from the cavity through the tube.

* * * * *